United States Patent [19]

Loiselle et al.

[11] Patent Number: 5,058,352

[45] Date of Patent: Oct. 22, 1991

[54] BARRIER SYSTEM

[76] Inventors: Scot D. Loiselle, 8380 Tamar Dr., Columbia, Md. 21045; Michael W. Riffle, 13 Sonata Ct., Silver Spring, Md. 20901; Patrick K. Burke, 3174 Westdale Ct., Waldorf, Md. 20601

[21] Appl. No.: 591,212

[22] Filed: Oct. 1, 1990

[51] Int. Cl.[5] ..... E04B 2/00; E04B 1/62

[52] U.S. Cl. ..... 52/406; 52/404; 52/407; 52/696

[58] Field of Search ..... 52/404, 406, 407, 696, 52/489

[56] References Cited

U.S. PATENT DOCUMENTS

| | | | |
|---|---|---|---|
| 1,915,697 | 6/1933 | Robinson | 52/696 |
| 2,999,277 | 9/1961 | Spencer et al. | 52/489 |
| 2,999,278 | 9/1961 | Spencer et al. | 52/489 |
| 3,662,509 | 5/1972 | Studzinski | 52/404 |
| 4,379,381 | 4/1983 | Holcombe | 52/404 |
| 4,879,856 | 11/1989 | Jones et al. | 52/407 |

FOREIGN PATENT DOCUMENTS

| | | | |
|---|---|---|---|
| 78021 | 5/1983 | European Pat. Off. | 52/404 |
| 2315793 | 10/1974 | Fed. Rep. of Germany . | |
| 2340309 | 2/1975 | Fed. Rep. of Germany . | |

*Primary Examiner*—John E. Murtagh
*Assistant Examiner*—Deborah M. Ripley
*Attorney, Agent, or Firm*—Morris Kaplan

[57] ABSTRACT

A continuous barrier is formed by channeled cap members which each receive therein a respective truss. Structure that is integral with flange elements of the cap and integral with the ends of hangers that span the cap flanges effect means to removably lock and substantially stabilize the assembly of caps and hangers, which assembly provides a generally planar support surface for fire rated gypsum board and the like.

11 Claims, 4 Drawing Sheets

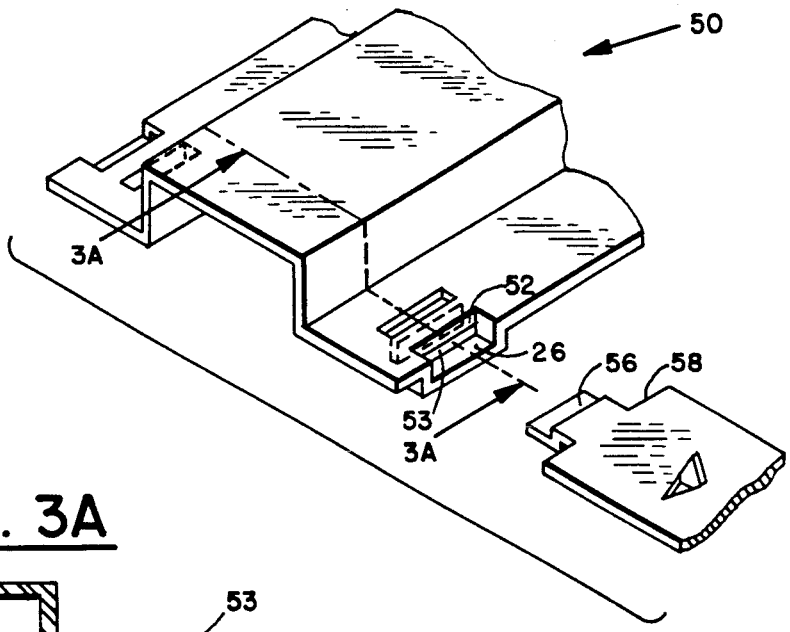
FIG. 3
FIG. 3A
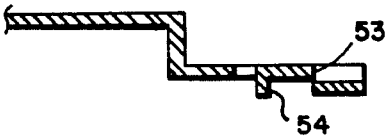
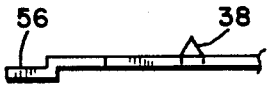
FIG. 3B
FIG. 4
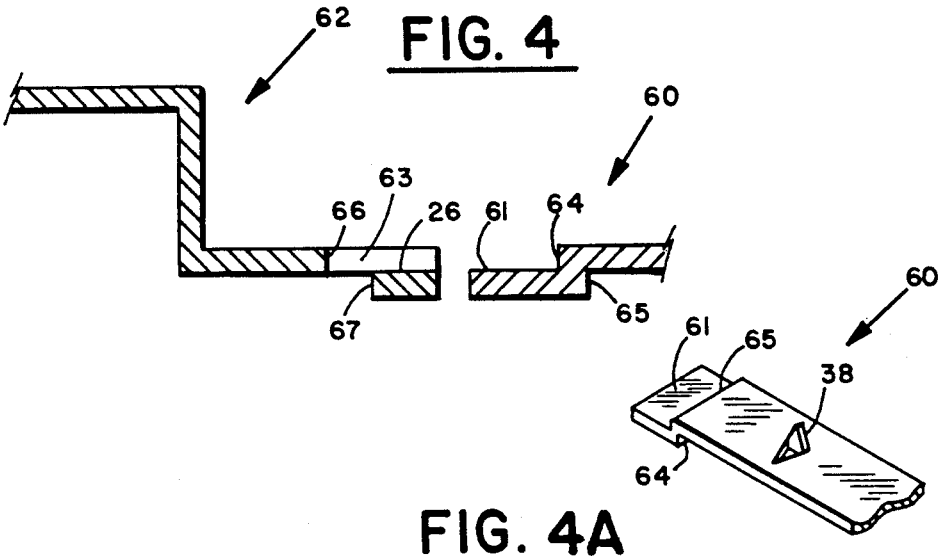
FIG. 4A

FIG. 5
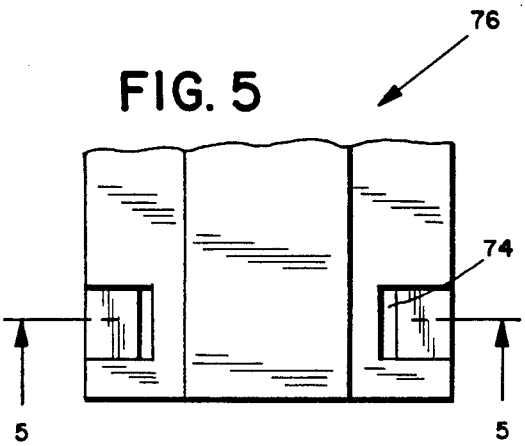
FIG. 5B
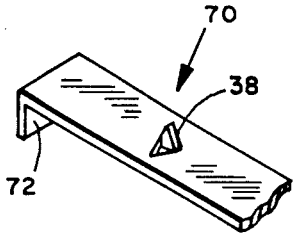
FIG. 5A
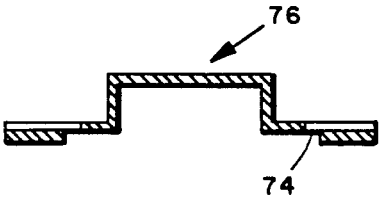
FIG. 5C
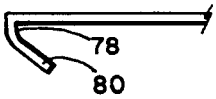
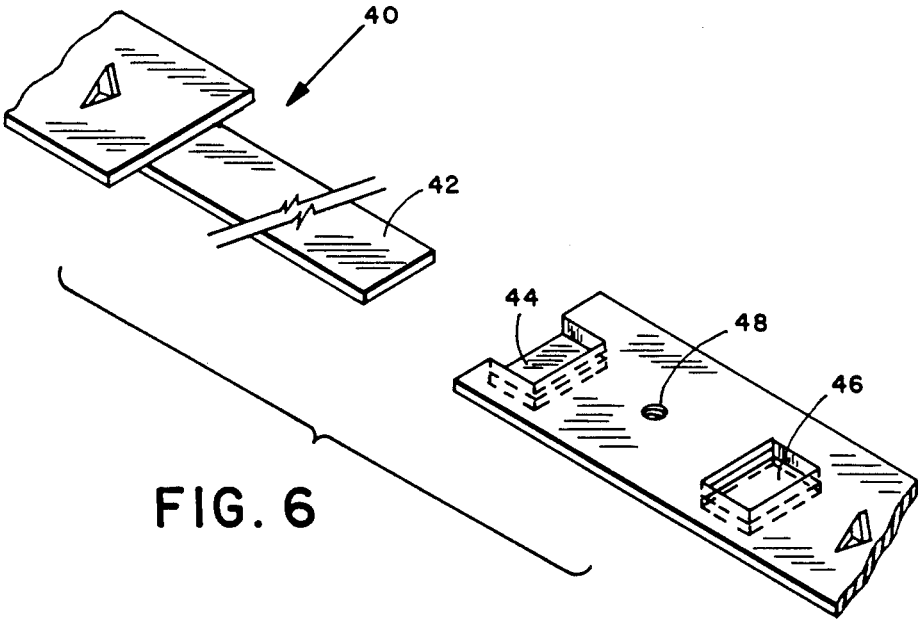
FIG. 6

BARRIER SYSTEM

TECHNICAL FIELD

The present invention relates to means for supporting sheet material in standing structures; for instance, sheeting for moisture barrier batting, sound or thermal insulation and fire rated board.

BACKGROUND OF THE INVENTION

With regard to standing structure, it may be required to install any or all of a moisture barrier, a sound or thermal insulation or fire rated board much as fire rated gypsum board.

One current problem with respect to such structures, characterized as being potentially disastrous to the home building industry and requiring billions of dollars to correct (*Professional Builder,* Technology, June 1990, pp. 80, 90, and *The Evening Sun,* Newspaper, Baltimore, Section A, March 28, 1990), is that much of fireretardant treated board chemically alters and deteriorates to the extent that whole roofs must be replaced.

Prior art devices adaptable for installations of the type are not uniformly cost efficient in fabrication, simplicity of assembly and completeness of structural area coverage.

In this connection, see the U.S. Pat. Nos. 2,999,277 and 2,999,278—Spencer et al.; U.S. Pat. No. 4,346,544 Larssen and West German Patents 2,315,793—Oct. 3, 1974, and 2,340,309—Feb. 20, 1975.

SUMMARY OF THE INVENTION

The present invention is directed to a novel and improved support means that are especially adapted for installation of barrier batting, insulation materials or fire-rated board.

It is an object of the invention that the members thereof be inexpensive to manufacture, simple and time efficient to assemble and install and that such assembly and installation require only simple physical effort and patentably obvious manual dexterity.

It is another object of the invention to provide a novel and improved hanger means.

It is a further object of the invention to provide a continuous system that includes means capping joists, rafters, truss chords, and the like that also interlock with hanger means and that such assemblage provide a generally planar surface for supporting fire-rated board or insulation and the like.

For a more fully developed presentation of the invention, and preferred embodiments thereof, reference is made to the following descriptive matter, appended claims and attached drawings.

BRIEF DESCRIPTION OF THE DRAWINGS

FIG. 3 is an exploded view of a second embodiment of the invention.

FIG. 3A is a partial cross-section of the cap of FIG. 3.

FIG. 3B is a partial side elevation of the hanger of FIG. 3.

FIG. 4 is an exploded view of third embodiment of the invention.

FIG. 4A is a perspective view of the hanger of FIG. 4.

FIG. 5 is a plan view of the cap of a fourth embodiment of the invention.

FIG. 5A is a partial sectional end view taken on cutline 5—5 of FIG. 5.

FIG. 5B is a perspective view of a hanger for use with the cap of FIG. 5.

FIG. 5C is a partial elevational side view of a modified hanger that is used with the cap of FIG. 5 and comprises a fifth embodiment of the invention.

FIG. 6 is a partial perspective of adjustment means adaptable for inclusion in the structure of any of the disclosed cap and hanger means.

DETAILED DESCRIPTION OF THE INVENTION

For purposes of clarity, the drawings are not completely drawn to scale. However, such drawings are clear and certain when taken with the following descriptive matter.

Figure 1:
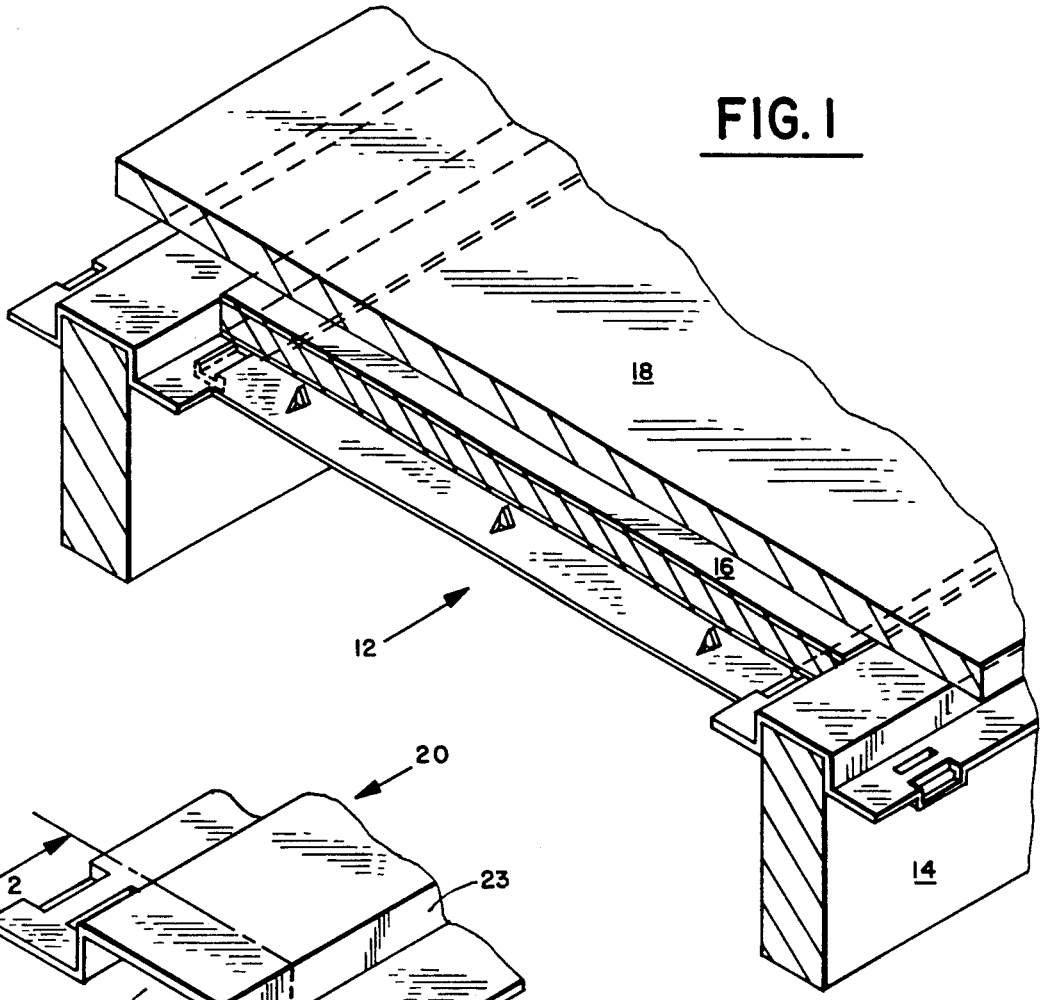
FIG. 1 is a perspective view of a first embodiment of the invention illustrated in functional disposition.
Figure 2:
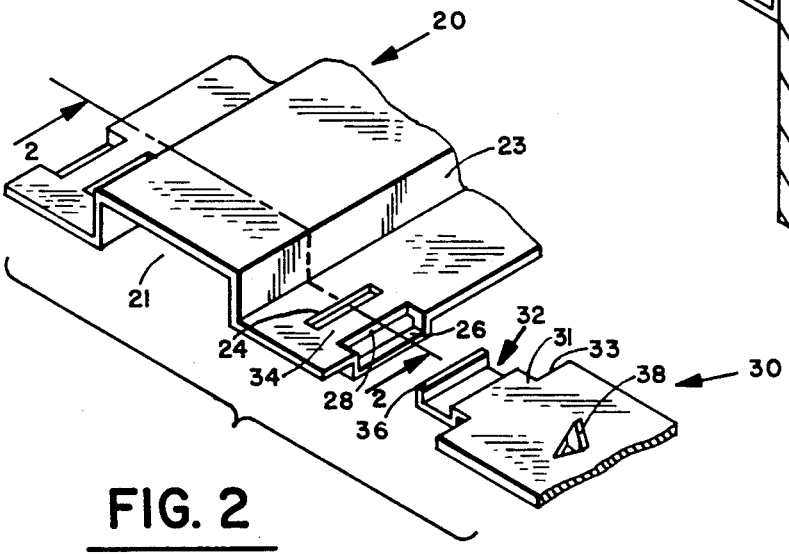
FIG. 2 is an exploded view of sections of cap and hanger members of FIG. 1.

Referring to the drawings which disclose preferred embodiments of the invention and wherein like numerals indicate like elements of structure, there is shown in FIGS. 1 and 2 a section 10 which illustrates support structure of the invention, 12, assembled and in place on top chords of truss members, rafters, joists or the like 14 (hereafter referred to as truss or trusses) internally supporting sheeting 16 such as a moisture barrier batting, thermal or sound insulation, fire-rated gypsum board or the like and covered by conventional sheathing 18.

The support structure 12 is comprised of channeled cap members 20 adapted to receive longitudinal, truss edge sections in channels 21. As illustrated in FIG. IA, flange elements 22 extend outwardly from, normal to, and coextensively with each channel sidewall 23 at the channel open end.

Each flange element 22 has a plurality of hanger support means spaced along the longitudinal extent thereof. Each said support means is comprised of an elongated slot 24 extending longitudinally through an intermediate section of the flange and a uniformly, outwardly depressed flange section that is disposed along the flange edge, is spaced from and transversely aligned with the slot 24, and forms a shelf surface 26 that is parallel to the general flange structure. As shown the latter is notched to form slot 27 as defined by edge walls 28, 29 of the flange and shelf, respectively.

Each hanger support means, in this and correspondingly so in all embodiments of the invention, is dimensioned to accommodate and support an end structure of hanger 30 that spans successive cap members 20 whereby, in assembly, the associated flanges and hangers form a generally planar surface for supporting sheeting 16.

Still referring to FIGS. 1, 2, each hanger end structure has a proximal section 31 that in assembly is supported on shelf 26 and a channel configured distal section 32 that extends from the terminus of the proximal section, extends through said slot 27, receives the intermediate flange section 34 in said channel 32, and has its forward wall 36 received in slot 24.

In said assembly, hanger shoulders 33 abut associated flange edge surfaces.

The hangers are each additionally formed with a plurality of sharply ended prongs 38 that are spacedly disposed along the length of the hanger and are adapted to piercedly receive the sheeting 16.

The hanger may optionally be of uniform width throughout its length and rigidity may be enhanced by ribbing.

To provide for non-uniformity of truss spacing. The hanger may be made extensible; as for instance, by means 40 (FIG. 6) wherein tongue 42 is received and supported by slot and shelf means 44, 46 correspond somewhat to slot 27 and shelf 26. A set screw 48 may be utilized to lock-in hanger adjustment. Such adjustment means may be incorporated in any of the hanger structures herein disclosed.

Figure 7:
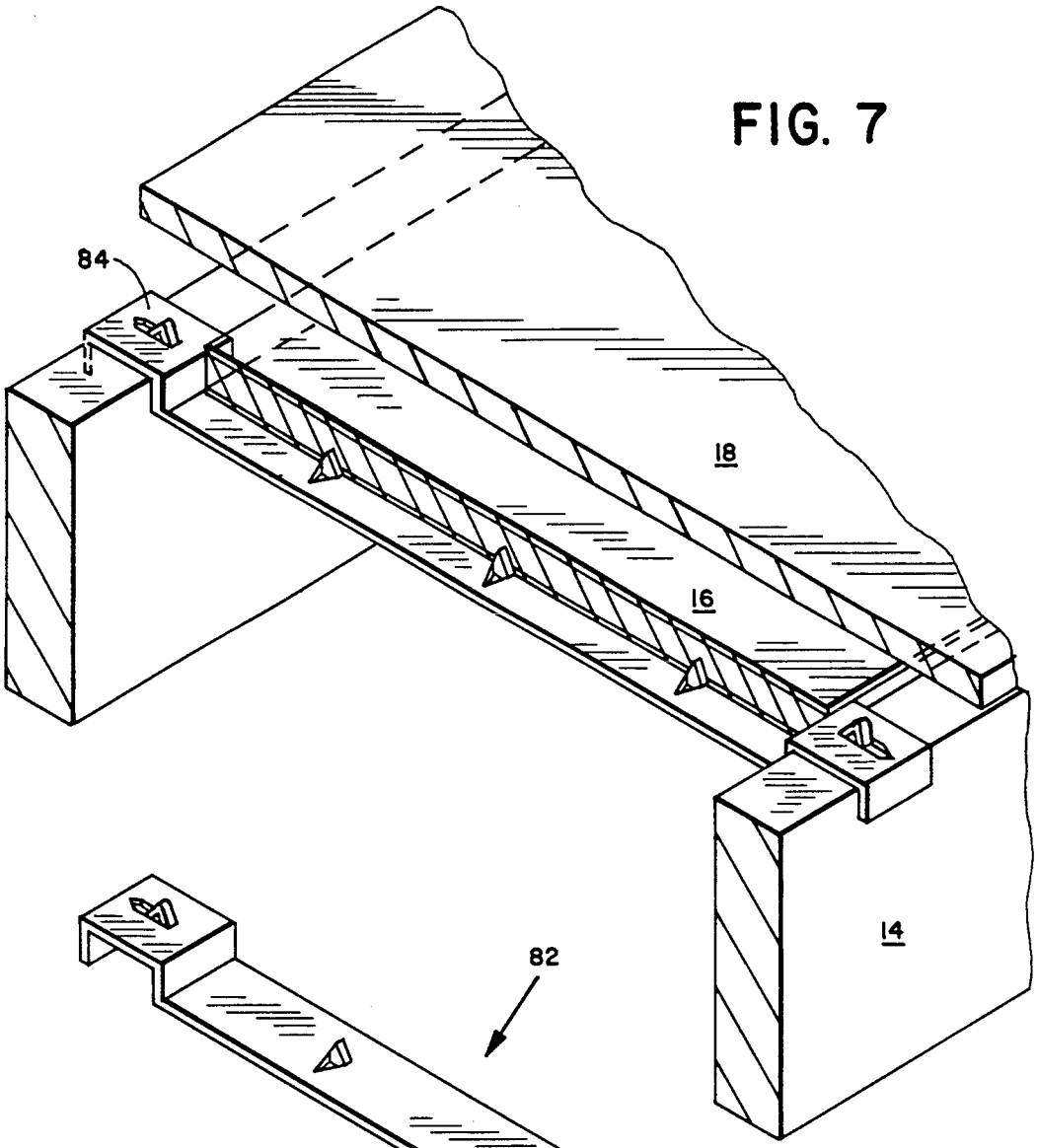
FIG. 7 is a perspective of a sixth embodiment of the invention illustrated in functional disposition.
Figure 7A:
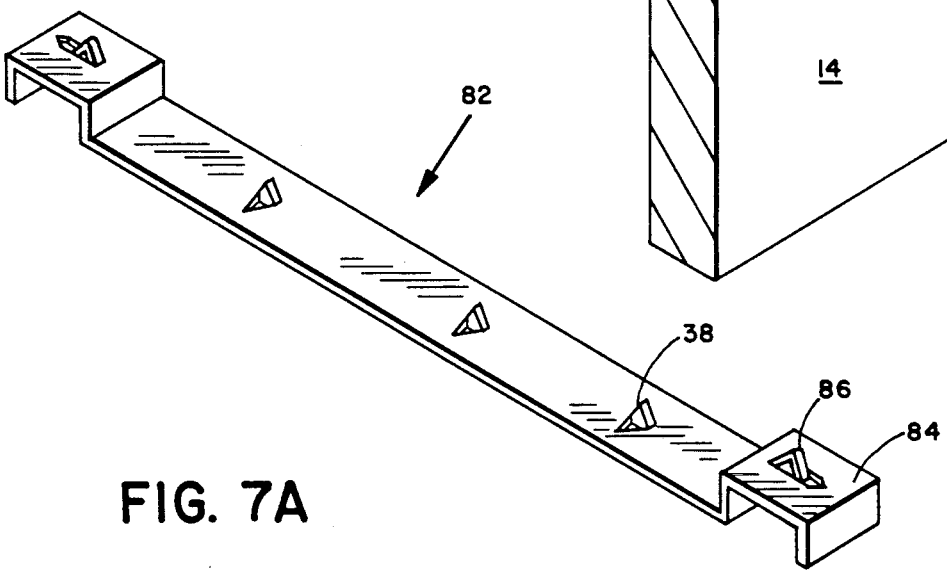

With respect to an end truss of the building framework, an end cap is utilized. An end cap differs from the cap 20 only in that either a single cap flange is presented with the cap channel or there is presented an end wall having a single flanged sidewall; the hanger support means being identical. Said cap end wall may be fixed to a truss by a speed prong that is formed integral with said end wall; see 86 of FIGS. 7, 7A.

In use of the embodiment of FIGS. 1, 2, cap members are placed on respective trusses; a hanger end and associated cap are then relatively tilted and manipulated to first insert one hanger end through a slot 27, receive the intermediate flange section 34 in channel 32 and finally insert hanger end wall 36 in flange slot 24.

Mounting of the hanger is completed by repeating the assembly process at the other end of the hanger and its associated cap. Each subsequent hanger is similarly mounted. A previously mounted hanger end is slidingly supported on its associated shelf 26 during handling of the cap at subsequent mountings.

In a second embodiment of the invention (FIGS. 3, 3A, 3B), the hanger support means and the hanger ends are modified. In cap 50 the shelf remains; flange edge wall 52 that limits the vertically exposed slot 53 is not notched and is in general planar alignment with shelf edge wall 29; and slot 24 has a stop-tab 54 depending therefrom.

The slot 24-tab 54 structure could be replaced by a non-break stamped protrusion.

Each hanger end structure, that operatively associates with cap 50, has a tongue portion 56 that is planarly offset to the depth of shelf 26 and in assembly has a proximal section that rests on said shelf and a distal section that extends through the slot 53 and is limited in such extension by tab 54. In assembly, hanger shoulders 58 abut associated shoulders of the cap flange to thereby provide an expanded, generally planar sheet support surface. Note that shoulders 58 also provide a stop means in cap-hanger association.

The stop-tab additionally functions as a safety device in that it is the means on which the forward end of tongue 56 slides when a cap member is tilted during a subsequent assembly operation, to thus prevent an override of parts and possible disassembly. The stop means could be inwardly configured whereby to limit the degree of said slide.

Figure 2A:
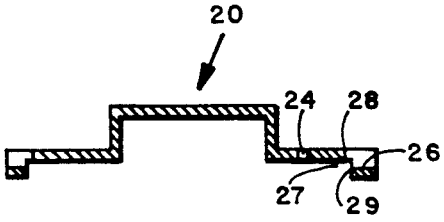
FIG. 2A is a partial cross-sectional view on cutline 2—2 of FIG. 2.

In a third embodiment of invention, hanger 60 (FIGS. 4, 4A) distinguishes from that of FIGS. 3, 3B in that the offset portion 61 is of shorter length and the hanger is preferably of a uniform width that conforms to that of shelf 26 of cap member 62 whose widened slot 63 corresponds to slot 27 in FIG. 2A.

In assembly, shoulders 64, 65 of the offset operatively associate with flange edge faces 66, 67 to effectively stabilize and lock the assembly.

Such effective stabilizing and locking could also be effected in the embodiment of FIGS. 3, 3A, 3B by changing the location of the offset in the end structure of hanger 38 and widening the cooperating hanger slot, as in the structure of FIGS. 2A, 4.

In a fourth embodiment of the invention (FIGS. 5, 5A, 5B), the hanger terminates in a generally right angled bend 70 whose terminal arm 72 operatively associates with shelf 26 and slot 74 of cap member 76. The width of slot 74 need only accommodate the hanger wall thickness.

In assembly, terminal arms 72 are inserted in respective cap member slots 74 and clinched, whereby the hanger seats on respective shelves 26 so as to present a generally planar sheet support surface and the assembly is then fixed.

In a fifth embodiment of the invention, FIG. 5C, the hanger overall end structure differs from that of FIG. 5B in that the proximal section 78 of the terminal arm is at a right angle, but beyond the extent to accommodate a cap-flange wall thickness, the arm is configured to present a small and preferably gradual inward bend 80. Further, at least said inwardly configured portion of the arm is fabricated of a slightly springy material that is easily manually manipulated.

After assembly, the memory characteristic of said material induces said inwardly configured arm portions into a locking disposition about the associated flanges.

A continuous barrier is formed when barrier sheet is made in each of the assembled cap-hanger embodiments of the invention.

The sixth embodiment of the invention (FIGS. 7, 7A) relates to a hanger only sheet support system, wherein hangers 82 terminate in channeled ends 84 adapted to cap the top sections of truss members 14 and be anchored thereto by driving home downwardly directed speed prongs 86 that are formed integral with ends 84. Upwardly directed prongs 38 receive the barrier sheet 16.

The embodiments shown and described are only illustrative of the present invention and are not to be construed as delimitive thereof; since once apprised of the invention, changes in structure would be readily apparent to one skilled in the art. One skilled in the art would for instance readily see that in the embodiment of FIGS. 1, 2, 2A, the shelf 26 level may be lowered and the hanger U-shape widened inwardly whereby the seat of the U-shape would be supported on the shelf.

Hence, the present invention includes all modifications of structure encompassed within the spirit and scope of the following claims.

We claim:

1. Means adapted to be mounted on trusses and the like, in a building structure, for supporting barrier sheeting, especially fire-rated board, and with said sheeting forming a continuous barrier; said means comprising:

a plurality of elongatedly channeled cap members adapted to be mounted on, and receive therein, the longitudinal edge section of a respective truss;

a flange element extending outwardly from, normal to and coextensive with the longitudinally open end of each sidewall of each said channel;

each said flange element is configured to have a plurality of hanger support means spaced along the length thereof;

each said hanger support means is comprised of a uniformly and outwardly depressed flange section that forms a shelf means which extends inwardly from the flange edge and the shelf of which is parallel to the general flange structure and open at each transverse end;

a plurality of hanger means that are each of a length to span the distance between consecutively mounted cap members and have end structures configured to be each received in and supported on respective ones of said shelf means;

said flange and hanger means being dimensionally and operationally related whereby in assembly a generally planar barrier sheet support surface is presented;

means removably locking and substantially stabilizing the assembled cap and hanger means; and means spaced along the length of said hanger means for positionally retaining said barrier sheeting.

2. Means for supporting barrier sheeting as in claim 1, wherein:

the inner longitudinal edge wall of said shelf and a transversely offset, coextensive and opposed edge wall of the general flange structure form a first slot; and in said assembly, each said hanger end structure extends, at least in part, through a respective said slot.

3. Means as in claim 2, wherein:

said end structures of the hanger are each planarly offset to the extent of hanger gauge; and said slot is of a dimension to closely accommodate said hanger offset;

whereby in said assembly, the hanger edge walls at the offset line operatively associate with a respective edge wall forming said slot to effect said means removably locking and substantially stabilizing the cap and hanger means.

4. Means as in claim 2, wherein:

the hanger end structures are each at a generally right angled bed to the body of the hanger;

in said assembly, the hangers are supported on respective shelves that are spanned and each said right angled bend extends through an associated one of said slots; and said right angled hanger end structures are clinched to effect said means removably locking and substantially stabilizing.

5. Means as in claim 2, wherein:

the hanger end structures each have a proximal section that is at a right angled bend to the hanger body and a distal section that has a slight inward bend;

the length of said proximal section is generally equal to the gauge of said shelf; and at least said distal section is fabricated of a slightly springy material;

whereby in said assembly, the memory characteristic of said material induces said distal sections into disposition about respective ones of said shelf means to effect said means removably locking and substantially stabilizing.

6. Means for supporting barrier sheeting as in claim 1, wherein:

said end structures of the hangers are each planarly offset and in said assembly, a proximal part, of each said offset part of the end structure, is supported on a respective on of said shelf means and the related distal part extends beyond the associated inner open end of the shelf;

a plurality of stop means are formed integral with said flanges;

each said stop means is aligned with a respective one of said shelf openings; and each said stop means is disposed to limit the distance that the associated distal end can extend beyond said opening;

whereby to thus effect said means removably locking and substantially stabilizing.

7. Means as in claim 6, wherein:

the stop means is configured so as to prevent an associated said distal section from passing thereunder when the caps and hangers are tilted during an assembly operation whereby to prevent disassembly caused by an override of structure.

8. Means as in claim 6, wherein:

each said end structure extends as a tongue from, and intermediate the width of, the hanger body; and in said assembly, the hanger body end surfaces that are in width external of said tongue, abut associated flange edges to thereby enhance stabilization of the assembly and extend said planar surface of the barrier sheet support.

9. Means for supporting barrier sheeting as in claim 2, wherein:

each said flange has a plurality of second slots which are each disposed intermediate a respective one of the first recited slots and its associated cap sidewall and in operational alignment with said respective first slot;

each said hanger end structure has a proximal section that in assembly is the aforerecited end structure received in and supported on said shelf means;

from the terminus of each said proximal section the hanger end structure extends in a channel configuration; and in said assembly, the flange section intermediate each aligned pair of said first and second slots is received in a respective said channel configuration with the terminal wall of the latter extending into a respective second slot whereby the effect said means removably locking and substantially stabilizing.

10. Means as in claim 1, wherein the hanger structures each include means to adjust the length thereof and means to lock-in any adjustment of said length.

11. Hanger means adapted to span and be mounted on consecutive trusses and the like, in a building structure, for supporting barrier sheeting, especially fire rated board, said means comprising:

elongated members that at each end terminate in a transversely oriented channel configuration;

each said channel being adapted to receive therein a top edge section of a respective truss;

means to adjust and lock-in the length of each said member whereby to accommodate non-conventional spacing of said trusses;

speed prong means formed integral with each said channel means whereby a member may be fully and firmly positioned on a pair of trusses and the speed prongs then driven to fix said positioning; and sharp-edged prong means disposed spacedly along the length of said member, and in direction opposed the channel means, for piercedly receiving and positionally retaining said barrier sheeting.

* * * * *